US009475548B1

(12) United States Patent
Slocum

(10) Patent No.: US 9,475,548 B1
(45) Date of Patent: Oct. 25, 2016

(54) MULTI-HULL PLATFORM BOAT

(71) Applicant: COBALT BOATS, LLC, Neodesha, KS (US)

(72) Inventor: Kim Slocum, Independence, KS (US)

(73) Assignee: COBALT BOATS, LLC, Neodesha, KS (US)

( * ) Notice: Subject to any disclaimer, the term of this patent is extended or adjusted under 35 U.S.C. 154(b) by 0 days.

(21) Appl. No.: 14/472,570

(22) Filed: Aug. 29, 2014

(51) Int. Cl.

| | |
|---|---|
| ***B63B 35/34*** | (2006.01) |
| ***B63B 3/48*** | (2006.01) |
| ***B63B 1/12*** | (2006.01) |
| *B63B 35/00* | (2006.01) |

(52) U.S. Cl.
CPC ..... *B63B 1/125* (2013.01); *B63B 3/48* (2013.01); *B63B 35/34* (2013.01); *B63B 2035/004* (2013.01)

(58) Field of Classification Search
CPC ..... B63B 1/125; B63B 3/48; B63B 35/34
USPC ..... 114/61.1–61.2
See application file for complete search history.

(56) References Cited

U.S. PATENT DOCUMENTS 3,090,339 A 5/1963 Carr
3,401,663 A * 9/1968 Yost ..... B63B 1/14 114/283
3,623,444 A * 11/1971 Lang ..... B63B 1/107 114/277
3,731,644 A 5/1973 Bradt
4,286,533 A * 9/1981 Sanner ..... B63B 1/14 114/123
4,295,236 A * 10/1981 Upchurch ..... B63B 1/121 114/357
4,716,847 A * 1/1988 Wilson, Jr. ..... B63B 1/14 114/279
4,738,215 A 4/1988 McMahon
4,777,898 A 10/1988 Faulkner
D298,310 S 11/1988 Robbins (Continued)

FOREIGN PATENT DOCUMENTS

DE 43 28 012 2/1995
WO WO 2009/145689 12/2009

(Continued)

OTHER PUBLICATIONS

Kemp et al., Design and installation of a commercial fibre composite pontoon, Australasian Structural Engineering Conference 2012: The past, present and future of Structural Engineering, (Abstract) (2 pgs).

(Continued)

*Primary Examiner* — Lars A Olson
*Assistant Examiner* — Jovon Hayes
(74) *Attorney, Agent, or Firm* — Stinson Leonard Street LLP

(57) ABSTRACT

In a first aspect, a multi-hull platform boat comprises an upper deck or platform that is secured to a plurality of longitudinally extending hulls via a plurality of corresponding longitudinally extending connectors. Each connector extends from the bottom of the platform above a corresponding hull. The platform is constructed with a continuous uninterrupted planar lower support spanning the area between the connectors. The lower support is preferably made from one or more moldable materials and may be covered with a finish coating. In a second aspect, a multi-hull platform boat has a platform with a relatively planar upper support surface and a wedge-shaped base extending from the upper support surface of the platform to the bottom of the hulls. The base is wedge-shaped such that it increases in height from the front to the rear of the boat.

30 Claims, 13 Drawing Sheets

(56) References Cited

U.S. PATENT DOCUMENTS 4,813,366 A * 3/1989 Elder ..... B63B 1/04 114/290
4,817,548 A * 4/1989 Guergen ..... B63B 3/38 114/61.21
4,821,667 A 4/1989 Hargett, Sr.
4,829,926 A * 5/1989 Voelkel ..... B63B 1/121 114/352
4,856,445 A * 8/1989 Kiper ..... B63B 1/125 114/129
4,867,093 A 9/1989 Sullivan
4,907,518 A * 3/1990 Tunis, III ..... B63B 1/125 114/271
5,006,391 A 4/1991 Biersach
5,024,177 A * 6/1991 Winter ..... B63B 35/7966 114/39.16
5,188,049 A * 2/1993 Graf ..... B63B 1/12 114/61.2
5,517,940 A * 5/1996 Beyer ..... B63B 1/14 114/354
5,524,564 A * 6/1996 Porada ..... B63C 11/02 114/315
5,564,955 A * 10/1996 Ingraham ..... B63H 20/007 114/343
5,590,616 A * 1/1997 Vera ..... B63B 1/14 114/261
5,651,706 A 7/1997 Kasper
5,682,831 A * 11/1997 Yokoi ..... B63B 43/14 114/123
5,784,977 A 7/1998 Schell et al.
5,823,130 A * 10/1998 Kreyn ..... B63B 1/12 114/61.14
6,073,569 A * 6/2000 Motsenbocker ..... B63B 1/107 114/121
6,089,176 A 7/2000 Costello
6,240,865 B1 * 6/2001 Hubbard ..... B63B 1/125 114/39.28
6,367,406 B1 4/2002 Sahr et al.
6,477,969 B2 11/2002 Schell-Tomczak et al.
6,516,736 B1 2/2003 Van Lancker
6,564,735 B1 5/2003 Jackson
6,598,552 B1 * 7/2003 Rouse ..... B63B 1/12 114/292
6,725,798 B1 * 4/2004 Hill ..... B63B 1/121 114/347
6,851,378 B2 * 2/2005 Amory ..... B63B 1/121 114/39.28
6,941,888 B2 9/2005 Barsoum
7,040,244 B1 * 5/2006 Ferran ..... B63B 1/107 114/283
7,143,540 B2 * 12/2006 Lessman ..... A01K 77/00 43/11
7,487,734 B2 * 2/2009 Davis ..... B63C 13/00 114/343
7,536,966 B2 * 5/2009 Stryjewski ..... B63B 7/04 114/61.1
7,950,340 B1 * 5/2011 Curtis ..... B63B 1/20 114/61.1
8,132,523 B2 * 3/2012 White, Jr. ..... B63B 7/04 114/352
8,186,291 B1 5/2012 Curtis
8,480,443 B2 7/2013 Talos
8,943,994 B2 * 2/2015 Baldwin ..... B63B 1/14 114/284
2001/0032574 A1 10/2001 Newton et al.
2003/0121463 A1 * 7/2003 Rice ..... B63B 35/38 114/61.1
2003/0230227 A1 * 12/2003 Wright ..... B63B 27/143 114/343
2005/0250393 A1 11/2005 Fishburn et al.
2005/0281999 A1 12/2005 Hofmann et al.
2007/0295264 A1 12/2007 Fishburn
2009/0031939 A1 2/2009 Fishburn
2010/0229775 A1 * 9/2010 Cochran ..... B63B 43/12 114/61.1
2013/0025519 A1 * 1/2013 Cooney ..... B63B 1/12 114/61.1
2013/0068151 A1 * 3/2013 Heyring ..... B63B 1/14 114/61.15
2014/0378012 A1 * 12/2014 Parkinson ..... B63B 1/121 440/1

FOREIGN PATENT DOCUMENTS

WO WO 2009/147448 12/2009
WO WO 2013/122476 8/2013

OTHER PUBLICATIONS

Fun Chaser Pontoon Boats by Carolina Skiff website; http://www.carolinaskiff.com/boats/fun-chaser/pontoon [downloaded from the internet on Feb. 20, 2014] (4 pgs).

* cited by examiner

MULTI-HULL PLATFORM BOAT

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

1. Field of the Invention

The present invention relates in general to multi-hull platform boats. More particularly, one aspect of the present invention relates to a multi-hull platform boat having one or more longitudinally extending connectors for securing the platform above the hulls. Another aspect of the present invention relates to a multi-hull platform boat having a wedge-shaped base to achieve a level upper platform surface when the boat is afloat and relatively stationary in calm water.

2. Description of Related Art

Multi-hull platform boats such as pontoon boats are frequently used for leisure and entertainment purposes. Multi-hull platform boats have relatively flat decks or platforms that accommodate larger groups of passengers than do the majority of mono-hull speed boats. These platforms are typically constructed of sheets of plywood that are secured to a plurality of crossbeams extending transversely across the width of the boat under the plywood sheets. The crossbeams are secured directly or indirectly on top of two or three longitudinally extending pontoon hulls. The crossbeams are generally made from metal and are joined to both the overlying plywood sheets and the underlying hulls via fasteners such as nails, screws, and/or bolts. The top of the plywood sheets are typically outfitted with seating, a captain's station, railing, gates, and the like, and the open areas are covered with outdoor carpeting or vinyl. Notably, the underside of the plywood sheets and the crossbeams are exposed to the elements. An inboard or outboard engine or engines is also installed at or near the rear of the boat. The weight of the boat is distributed primarily at its rear due to the engine(s), other mechanical components, and many times, seating and storage areas located at the rear of the boat.

The aforementioned traditional construction of multi-hull platform boats leads to a number of problems over time and with continued use of the boat. First, a multi-hull platform boat with plywood panels is prone to both rot and decay given that the plywood panels are exposed to the elements and frequently come into contact with air and water during use. Second, the crossbeams in combination with the fasteners are prone to bending, cracking, and loosening due to the boat's recurring rough impacts with the water and crashing waves. The fasteners themselves may also be prone to corrosion due to exposure to air and water. In addition, because the crossbeams extending between the pontoon hulls and below the platform are exposed, the boat's aerodynamic and hydrodynamic performance suffers due to friction, or drag, caused by both air and water hitting the crossbeams as the boat moves through the water. This drag also contributes to undesirable noise when the boat is in motion. Although aluminum sheet metal and/or underskins that serve to reduce these problems by covering the exposed crossbeams as well as the bottom-side of the plywood sheets of the platform are available for installation on traditionally constructed multi-hull platform boats, the sheet metal and/or underskins may not completely cover or protect the crossbeams or plywood sheets of the platform from exposure to air or water, nor do they prevent bending, cracking, rot and/or corrosion of the crossbeams, plywood, or fasteners. They also can add additional weight and drag on the boat. Finally, the aluminum sheet metal and/or underskins contribute to substantial noise from the turbulent water and waves.

Another problem experienced with the construction of most motorized multi-hull platform boats is that, because much of the weight is distributed toward the rear of the boat where the motor is installed, the boat dips downward at the rear when the boat is afloat and relatively stationary in calm water. This in turn causes the upper surface of the platform on which the passengers stand or sit to be off-level (i.e., not parallel with the water line) and instead angles downwardly toward the rear of the boat.

It is thus an object of the present invention to provide a multi-hull platform boat that is less prone to rot, decay, and/or corrosion.

It is a further object of the present invention to provide a multi-hull platform boat with a platform, connectors, and/or fasteners that are less prone to bending and cracking.

It is another object of the present invention to provide a multi-hull platform boat that has increased performance and is more hydrodynamic, aerodynamic, and quieter than multi-hull platform boats of traditional construction.

A further object of the present invention is to provide a multi-hull platform boat wherein the upper support surface of the platform is substantially parallel with the water line when the boat is afloat and relatively stationary in calm water.

BRIEF SUMMARY OF THE INVENTION

In a first aspect, the multi-hull platform boat of the present invention comprises an upper deck or platform that is secured to a plurality of longitudinally extending hulls via a plurality of corresponding longitudinally extending stringers or connectors. At least a portion of each connector extends along the bottom of the platform above a corresponding hull and is either integrally formed with the bottom of the platform or secured thereto. At least a portion of each connector is also secured directly or indirectly to an underlying hull. Since the connectors extend longitudinally along the bottom of the platform aligned above the hulls, there are no crossbeams extending below the platform between the hulls to secure the platform in position thereby leaving that area relatively open and unobstructed. This allows the boat to move through the water with less drag and resistance than that caused by air and water hitting the crossbeams used in conventional platform boat constructions. The bottom of the platform is constructed with a continuous uninterrupted or solid planar lower support spanning the area between the connectors. The lower support of the platform, and optionally the exterior of a portion of the connectors, is preferably made from one or more moldable materials and may be covered with an outer water-resistant coating to provide a smooth outer finish.

In one embodiment of the first aspect of the invention, the platform has upper and lower support surfaces each constructed from one or more sheets or layers of a solid planar material to form a relatively unitary and uniform upper deck. The solid planar material is preferably a moldable material, more preferably a fiber reinforced material such as fiberglass. The upper and lower support surfaces may be covered with a water impervious finish such as a pigmented polyester resin coating (gel coat) or a two-part linear polyurethane finish to further protect the platform from the environment and provide a smooth attractive outer finish. The platform may include an inner core sandwiched between the upper and lower support surfaces. One or more crossbeams or stiffeners extending transversely across the platform may be included or embedded within the inner core to add additional support and rigidity to the platform. Since the stiffeners are embedded between the platform's upper and lower support surfaces, they are not exposed and do not create the type of resistance or drag that crossbeams extending below the platform create in conventional platform boat constructions. The inner core may also include a relatively lightweight filler material such as a foamed plastic or a thermoplastic material such as honeycomb thermoplastic to fill the space between the upper and lower support surfaces and the transversely extending stiffeners.

In one embodiment of the first aspect of the invention, the connectors include longitudinally extending rails each having a relatively flat upper surface bonded in abutting contact with a portion of the bottom of the platform using adhesive. Fasteners such as bolts, screws or nails are also secured through the connectors and corresponding portions of the lower support surface of the platform into the stiffeners in the inner core of the platform to fix the connectors to the platform. Each connector is also either directly secured to an upper portion of the corresponding hull or indirectly secured to the corresponding hull by attaching the connector to a hull riser extending upwardly from the corresponding hull.

In an alternative embodiment, the connectors include longitudinal beams extending downwardly from the bottom of the platform that are secured or mounted within mounting brackets. The beams are preferably integrally formed with the platform such that the outer surface of the beams is formed continuously with the lower support of the platform using a moldable material, preferably a fiber reinforced material such as fiberglass or fiberglass reinforced plastic ("FRP"). The beams may be integrally formed with the lower support by first positioning the inner cores of the beams to extend along the bottom of the inner core of the platform inner core and/or within a portion of the lower support of the platform. The inner cores of the beams may be made of high density foam, wood, plastic, metal or other durable material. The moldable material is then applied to the exposed surfaces of the inner cores of the beams and the surrounding area making up the lower support of the platform to encase the beams in position relative to the platform. The moldable material may in turn be covered with a water impervious finish such as a pigmented polyester resin coating (gel coat) or a two-part linear polyurethane finish to further protect the platform and beams from the environment and provide a smooth attractive outer finish. Alternatively, the beams are separately formed from the platform and bonded to the bottom of the platform using an adhesive such as a bonding composite, additional moldable materials such as fiberglass reinforced plastic, or via any other fastening means or materials. The beams are mounted within corresponding mounting brackets that are directly secured to an upper portion of the corresponding hull or indirectly secured to the corresponding hull by attaching the mounting bracket to a hull riser extending upwardly from the corresponding hull. The beams may be secured within the mounting brackets using bolts, screws, nails or other fastening means or materials.

A second aspect of the present invention is directed to a multi-hull platform boat having a platform with a relatively planar top surface and a wedge-shaped base extending from the top surface of the platform to the bottom of the hulls. The base is wedge-shaped such that it increases in height from the front to the rear of the boat. In this manner, the upper surface of the platform will sit relatively parallel with the water line when the boat is afloat and relatively stationary in calm water.

In one embodiment of the second aspect of the invention, the boat has longitudinally extending connectors that are wedge-shaped such that they increase in height from the front to the rear of the boat. Each connector is secured above a corresponding hull to the bottom of the platform as heretofore described in relation to the first aspect of the invention.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
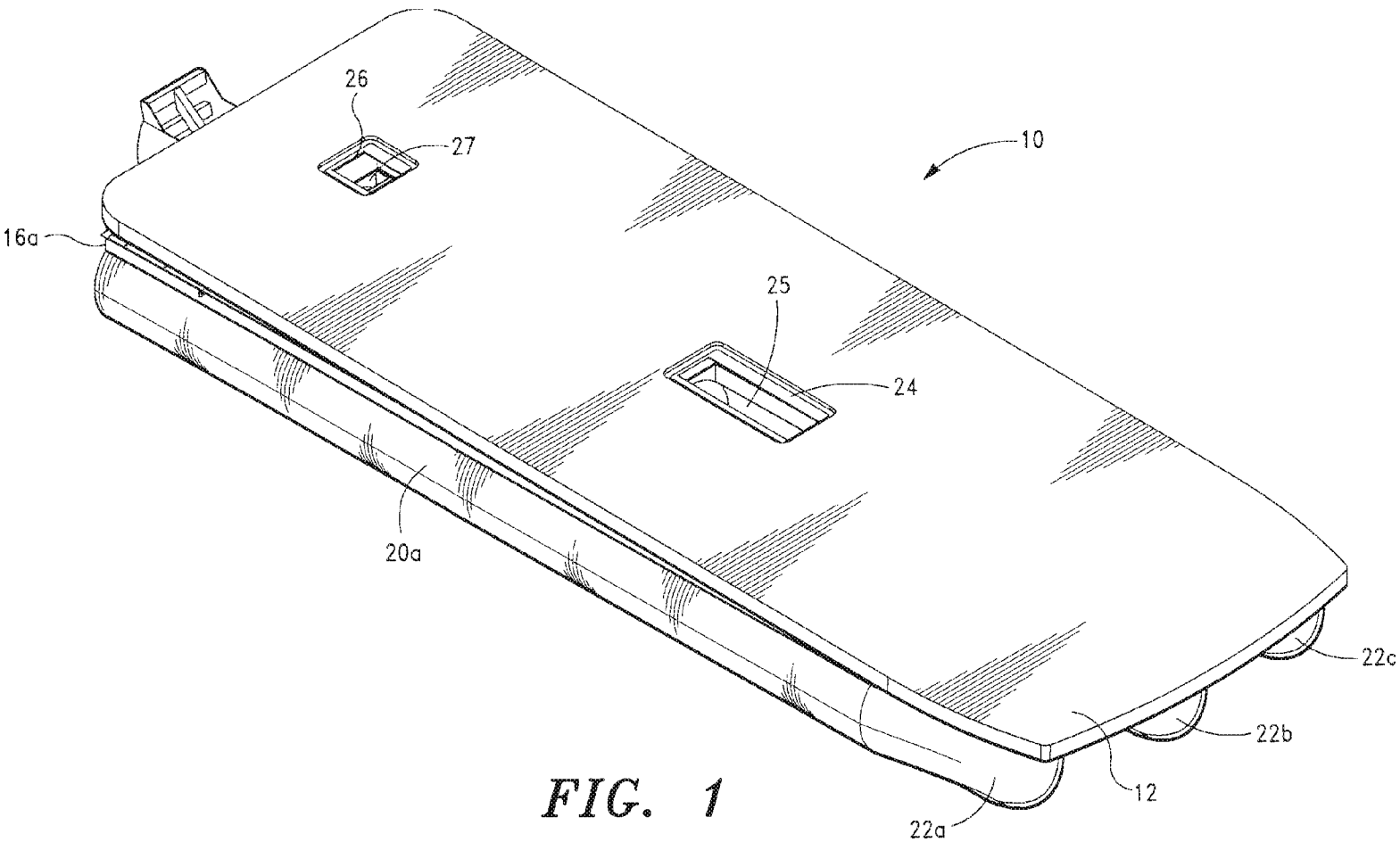
FIG. 1 is a perspective view of a multi-hull platform boat in accordance with a first exemplary embodiment of the present invention.
Figure 2:
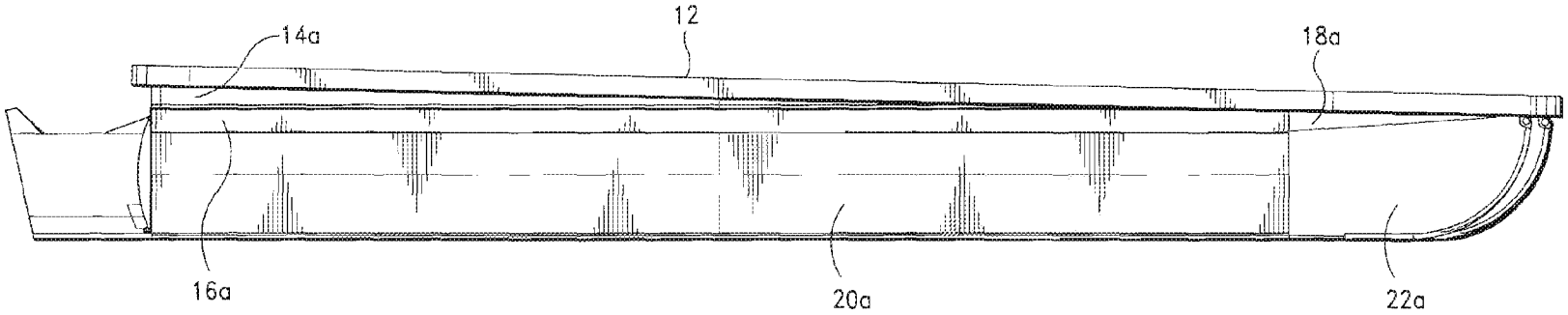
FIG. 2 is a side-view of the boat of FIG. 1.
Figure 3:
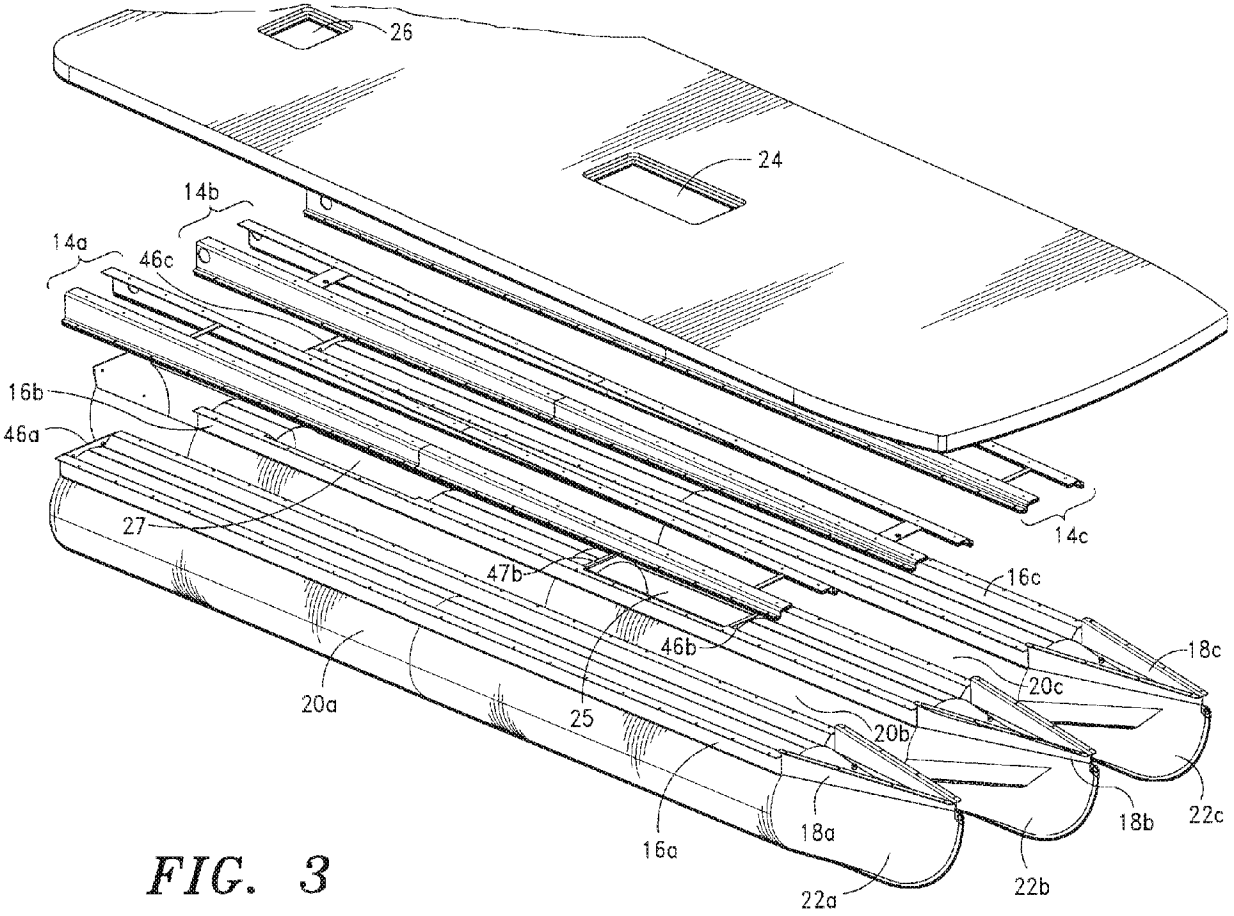
FIG. 3 is an exploded view of the boat of FIG. 1.

Looking to FIGS. 1-3, a multi-hull platform boat in accordance with a first exemplary embodiment of the present invention is generally designated by the numeral 10. Boat 10 includes a generally rectangular platform 12 defining the upper deck of the boat. Longitudinally extending connectors 14*a*, 14*b*, 14*c* secured to the underside of platform 12 are attached to corresponding hull risers 16*a*, 16*b*, 16*c* that extend upwardly from hulls 20*a*, 20*b*, 20*c* respectively (FIG. 3). Nose cone risers 18*a*, 18*b*, 18*c* extend upwardly from respective hull nose cones 22*a*, 22*b*, 22*c* and are secured along the underside of the front of platform 12. Opening 24 near the center of platform 12 provides access to an underlying storage compartment 25 in center hull 20*b*. In addition, access panel opening 26 near the rear of platform 12 allows for service and maintenance to a fuel tank area 27 contained within center hull 20*b*. The boat may be outfitted with various components as is known in the art including seating, a captain's station, railing, storage benches, tables, and the like on top of the platform, as well as a motor and stairs at the back of the boat. Electrical wiring and controls will also be included as is known in the art and additional openings may be included within the platform, connectors, and hulls to provide access to or support these components.

Figure 4:
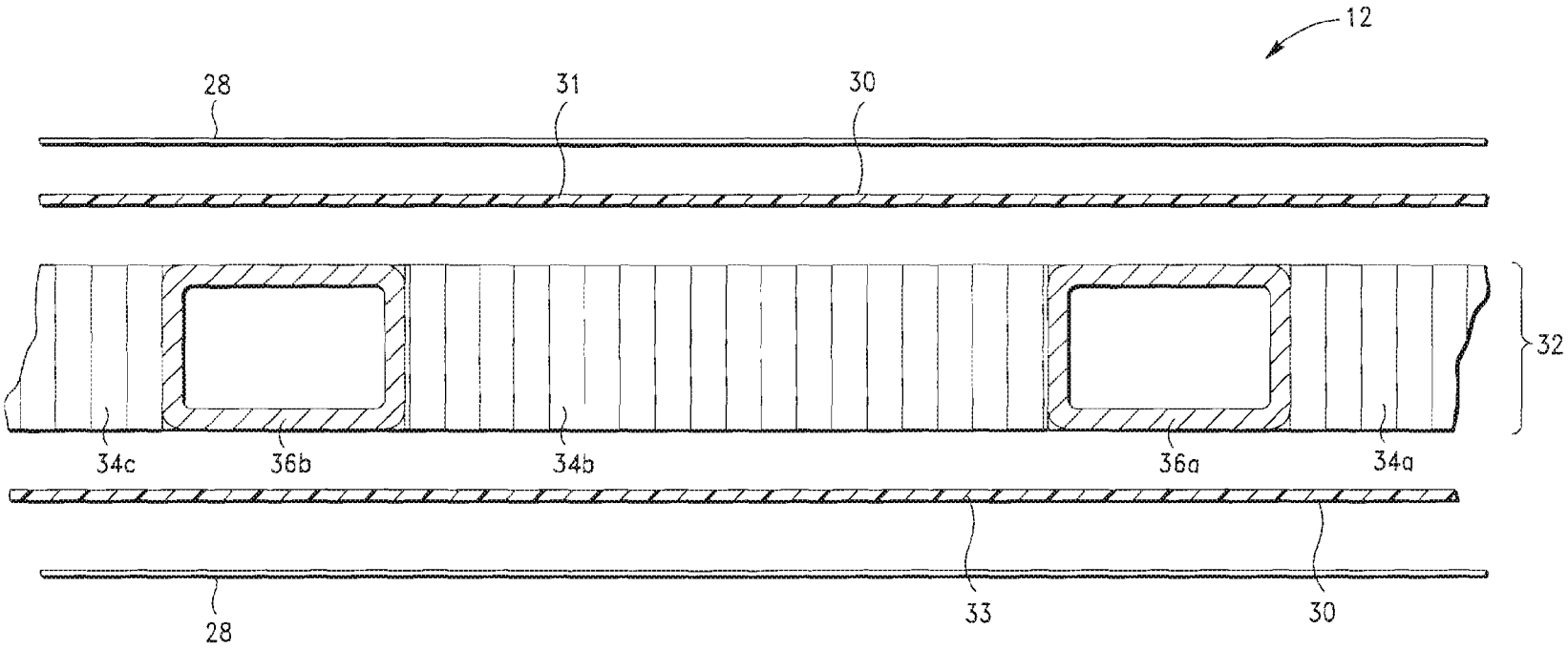
FIG. 4 is a cross-sectional exploded side-view of a portion of the platform of the boat of FIG. 1.
Figure 5:
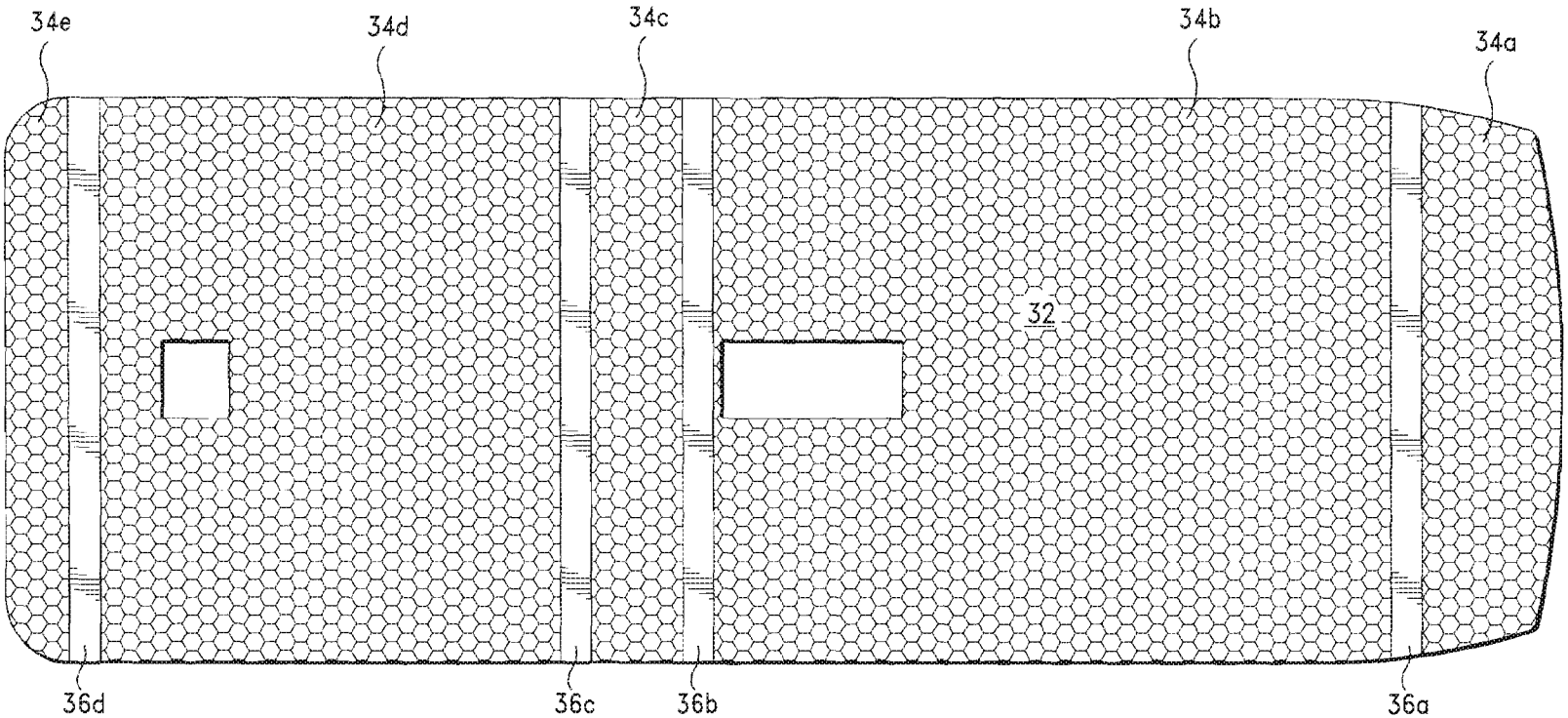
FIG. 5 is a top-plan view of the inner core of the platform of the boat of FIG. 1 with the outer coating and shell removed.

Looking to FIGS. 4 and 5, platform 12 has an inner core 32 embedded within or encased by a shell 30 that is covered with a water-impermeable outer coating 28. Platform 12 preferably has an overall length ranging from about 18 to 30 feet, a maximum width ranging from about 8 to 10 feet and a uniform height or thickness ranging from 1 to 2.5 inches. As best seen in FIGS. 1 and 5, platform 12 is rounded along each corner and has a slightly inwardly tapered front nose. Inner core 32 is a generally rectangular, relatively planar body of uniform height that extends longitudinally from the front to the back of platform 12 and transversely from the left to the right side of platform 12. Filler sections 34*a*, 34*b*, 34*c*, 34*d*, 34*e* extending transversely from one side of the platform to the other side and longitudinally along a length of platform 12 are each made of a board or sheet of a filler material that has sufficient structure to fill the space, but is relatively light weight. Preferred filler materials include foamed plastics such as Styrofoam or high density foams, thermoplastics, honeycomb shaped thermoplastic cores, balsa wood or combinations thereof, with honeycomb thermoplastic cores being the most preferred. Honeycomb thermoplastic cores manufactured by PLASCORE® such as the "PC2 Polycarbonate Honeycomb," "PP Polypropylene Honeycomb," or "Infusion Grade PP Honeycomb" product lines are considered well suited to meet the needs of the present invention. While the filler sections are depicted as boards or sheets of filler material, it is anticipated that the filler material could instead be a loose or fluid material molded or blown into place in the inner core.

Stiffeners 36*a*, 36*b*, 36*c*, 36*d* extending transversely across the width of inner core 32 from the left side edge to the right side edge of the inner core are positioned between filler sections 34*a*, 34*b*, 34*c*, 34*d*, 34*e* at various locations along the length of the boat. Specifically, for a platform having an overall length ranging from about 18 feet to 30 feet, a first filler section 34*a* extends from the front edge of inner core 32 a distance preferably ranging from fifteen inches to two feet or about 6% to 7% of the overall length of inner core 24. First stiffener 36*a* is positioned in abutting engagement with the rear edge of first filler section 34*a* and the front edge of the second filler section 34*b*. Second filler section 34*b* extends from the rear edge of first stiffener 36*a* a distance preferably ranging from 8 feet to 14 feet or about 46% to 47% of the overall length of inner core 32. Second stiffener 36*b* is positioned in abutting engagement with the rear edge of second filler section 34*b* and the front edge of the third filler section 34*c*. Third filler section 34*c* extends from the rear edge of second stiffener 36*b* a distance preferably ranging from 18 inches to 31 inches or about 8% to 9% of the overall length of inner core 32. Third stiffener 36*c* is positioned in abutting engagement with the rear edge of third filler section 34*c* and the front edge of fourth filler section 34*d*. Fourth filler section 34*d* extends from the rear edge of third stiffener 36*c* a distance preferably ranging from 5 feet to 9 feet or about 28% to 30% of the overall length of inner core 32. Fourth stiffener 36*d* is positioned in abutting engagement with the rear edge of fourth filler section 34*d* and front edge of the fifth filler section 34*e*. Fifth filler section 34*e* extends from the rear edge of stiffener 36*d* a distance preferably ranging from 9 inches to 15 inches or about 4% to 5% of the overall length of inner core 32 to the rear edge of inner core 32.

The length of stiffeners 36*a*, 36*b*, 36*c*, 36*d* is approximately equal to the width of filler sections 34*a*, 34*b*, 34*c*, 34*d*, 34*e* such that inner core 32 is of generally uniform width from the front to the rear, with a slightly inward taper at the front. Likewise, the height of stiffeners 36*a*, 36*b*, 36*c*, 36*d* is approximately equal to the height of filler sections 34*a*, 34*b*, 34*c*, 34*d*, 34*e* such that inner core 32 is in turn of generally uniform height from the front to the rear. However, it should be understood that stiffeners 36*a*, 36*b*, 36*c*, 36*d* could be shorter in length and/or height and the filler material could be positioned to fill any gaps. For a platform having a uniform height or thickness ranging from about 1 to 2.5 inches, the height or thickness of inner core 32 will range from about 0.5 to 1.5 inches or about 50% to 60% of platform 12.

Stiffeners 36*a*, 36*b*, 36*c*, 36*d* may be comprised of any relatively strong material capable of providing support to inner core 32 and shell 30. Suitable materials include wood, plastics, composite materials, metal and combinations thereof, with metal being preferred and aluminum being most preferred. As best depicted in FIG. 4, stiffeners 36*a*, 36*b*, 36*c*, 36*d* are hollow rectangular beams. However it should be understood that other configurations of stiffeners are also suitable for purposes of the invention. For example, the stiffeners may have a square, round, hexagonal, or other shape cross-section. In addition, while a hollow construction is preferred to make the stiffeners lighter and reduce material costs, it is also anticipated that a solid beam could be used.

Looking to FIGS. 1 and 4, shell 30 has a generally planar solid horizontally extending upper support surface 31, and a generally planar solid horizontally extending lower support surface 33 corresponding in shape and extending beyond the outer perimeter of inner core 32 a distance equaling the thickness of shell 30. Generally vertical side edges of shell 30 extend between the outer edges of support surfaces 31, 33 to completely encase inner core 32.

Shell 30 is made of one or more layers of one or more moldable materials that, together with stiffeners 36*a*, 36*b*, 36*c*, 36*d* provide sufficient strength to support the seating, railing, captain's station and other elements positioned on top of platform 12, as well as the anticipated passengers on boat 10. "Moldable material" for purposes of the present invention means any material capable of being formed into a desired shape. In the preferred embodiment, the material is capable of forming a solid outer shell 30 of uniform thickness surrounding or encasing inner core 32. Acceptable moldable materials for purposes of this invention include composite materials, high density thermoplastics, high density thermosets, fiberglass reinforced plastics, fiber reinforced polymeric resins, fiberglass, and combinations thereof. These materials can be formed into the shell using techniques known in the art. For example, sheets of the material can be laminated in a form and cured around inner core 32 or the material can be introduced into a mold (such as via injection molding) and cured around inner core 32. In a preferred embodiment, composite materials are used to form the shell 30, preferably fiber reinforced polymeric resins, and most preferably fiberglass.

The thickness of shell 30 may vary depending on the material used to form it, but for a boat having a length ranging from about 18 to about 30 feet and a maximum width ranging from about 8 to about 10 feet, the shell preferably has a minimum thickness of at least 1 inch, preferably a thickness ranging from 1 to 2.5 inches. For a shell made from fiber-reinforced polymeric resins, the minimum thickness is at least 1 inch and preferably ranges from 1 to 2.5 inches. In addition, while shell 30 is of uniform thickness in the preferred embodiment depicted in the drawings, it is anticipated that the upper and lower support surfaces and/or the sides of the shell may be of different thicknesses.

Outer coating 28 may be any water impervious finish coating capable of creating a smooth and attractive appearance to the platform. Preferred coating materials include pigmented polyester resin coatings, also known as "gel coats," and two-part polyurethane finishes as are known in the art for use on boat hulls, with two part-polyurethane finishes being preferred.

Platform 12 may be made utilizing an open-topped mold or form having a relatively flat bottom and peripheral sidewalls corresponding to the desired outer shape of the bottom surface and sides of platform 12. First, a two-part polyurethane finish is applied to the inner bottom and sidewalls of the mold to form the bottom and sides of outer coating 28. Layers or sheets of fiberglass are next positioned on top of the two-part polyurethane finish to form lower shell surface 33 and the sides of shell 30. Stiffeners 36*a*, 36*b*, 36*c*, 36*d* and filler section panels 34*a*, 34*b*, 34*c*, 34*d*, 34*e* are positioned side by side in abutting engagement on top of the lower shell surface 33 to form inner core 32. Fiberglass layers or sheets are then positioned over the top of the inner core to form upper shell surface 31 completely encasing inner core 32. Finally, a two-part polyurethane finish layer, or outer coating 28, is applied to upper shell surface 31. The two-part polyurethane finish and fiberglass resin are then permitted to fully cure before removing the finished platform from the mold.

Figure 6:
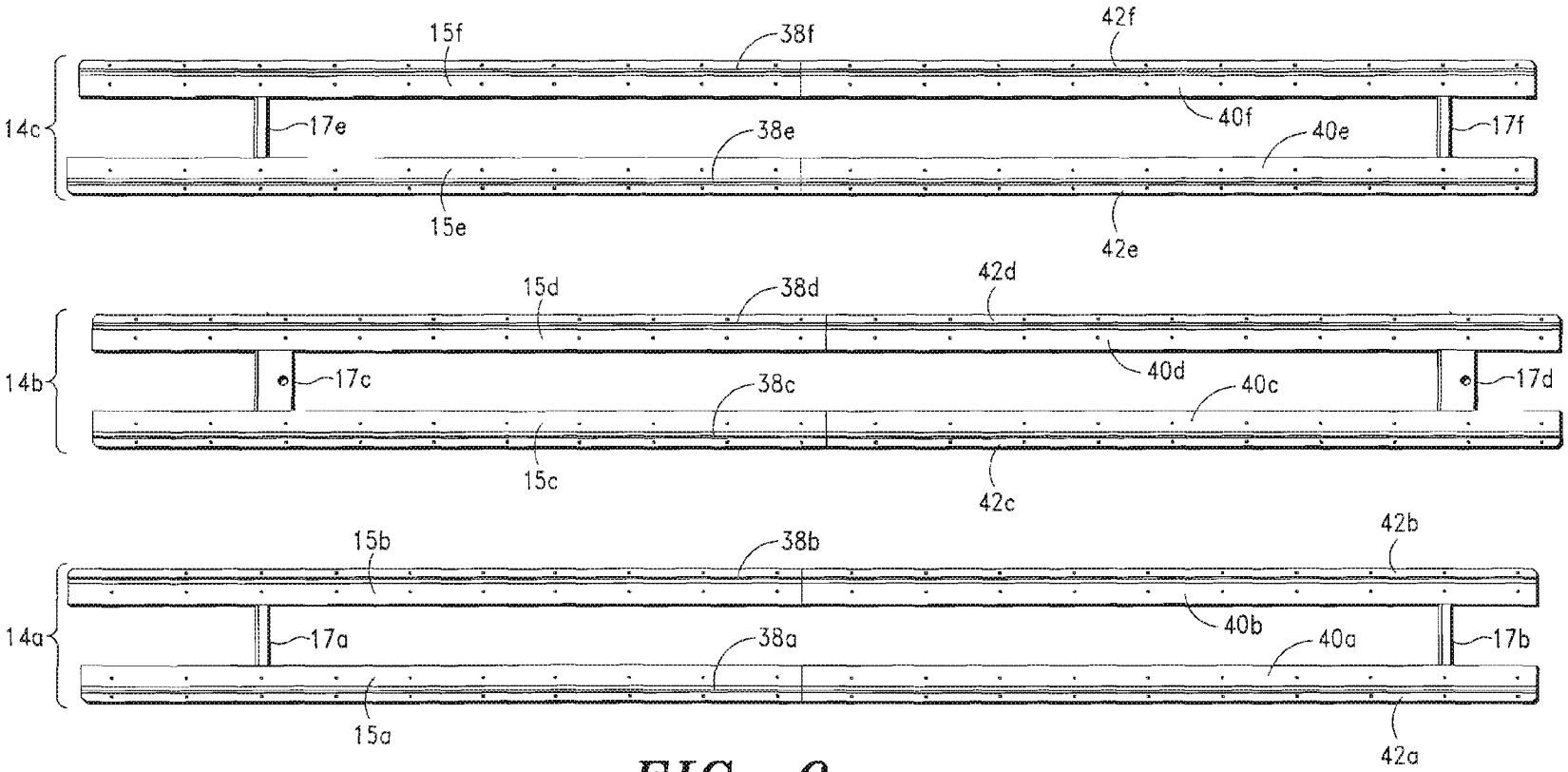
FIG. 6 is a top-plan view of the connectors of the boat of FIG. 1.
Figure 7:
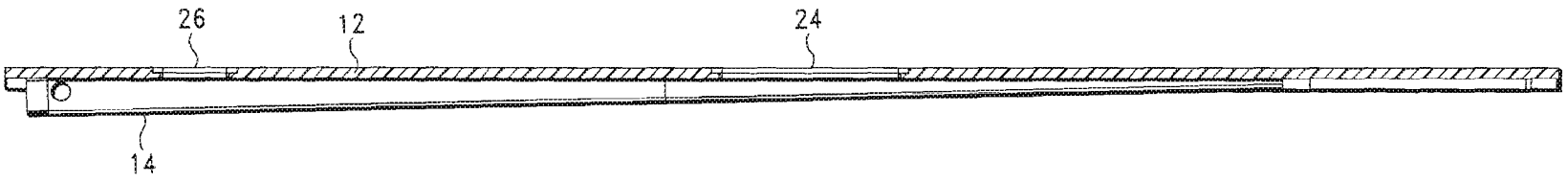
FIG. 7 is a side-view of the platform secured to the connectors of the boat of FIG. 1. Only one connector is visible.

Referring to FIGS. 3, 6 and 7, elongated connectors 14*a*, 14*b*, 14*c* are secured longitudinally along the bottom of platform 12 parallel to one another and aligned above corresponding hulls 20*a*, 20*b*, 20*c*. Specifically, connector 14*a* is secured along the left-hand or starboard side of platform 12 above the starboard side hull 20*a*, connector 14*b* is secured along the middle of platform 12 above the center hull 20*b*, and connector 14*c* is secured to the right-hand or port side of platform 12 above the port side hull 20*c*.

Looking to FIG. 6, each connector 14*a*, 14*b*, 14*c* has a pair of elongated side rails 15*a* and 15*b*, 15*c* and 15*d*, 15*e* and 15*f* extending parallel to one another with forward and rearward transverse rungs 17*a* and 17*b*, 17*c* and 17*d*, 17*e* and 17*f* extending respectively between each pair of side rails. The configuration of the side rail pairs 15*a* and 15*b*, 15*c* and 15*d*, 15*e* and 15*f* is the same for each respective connector 14*a*, 14*b*, 14*c*.

Figure 8:
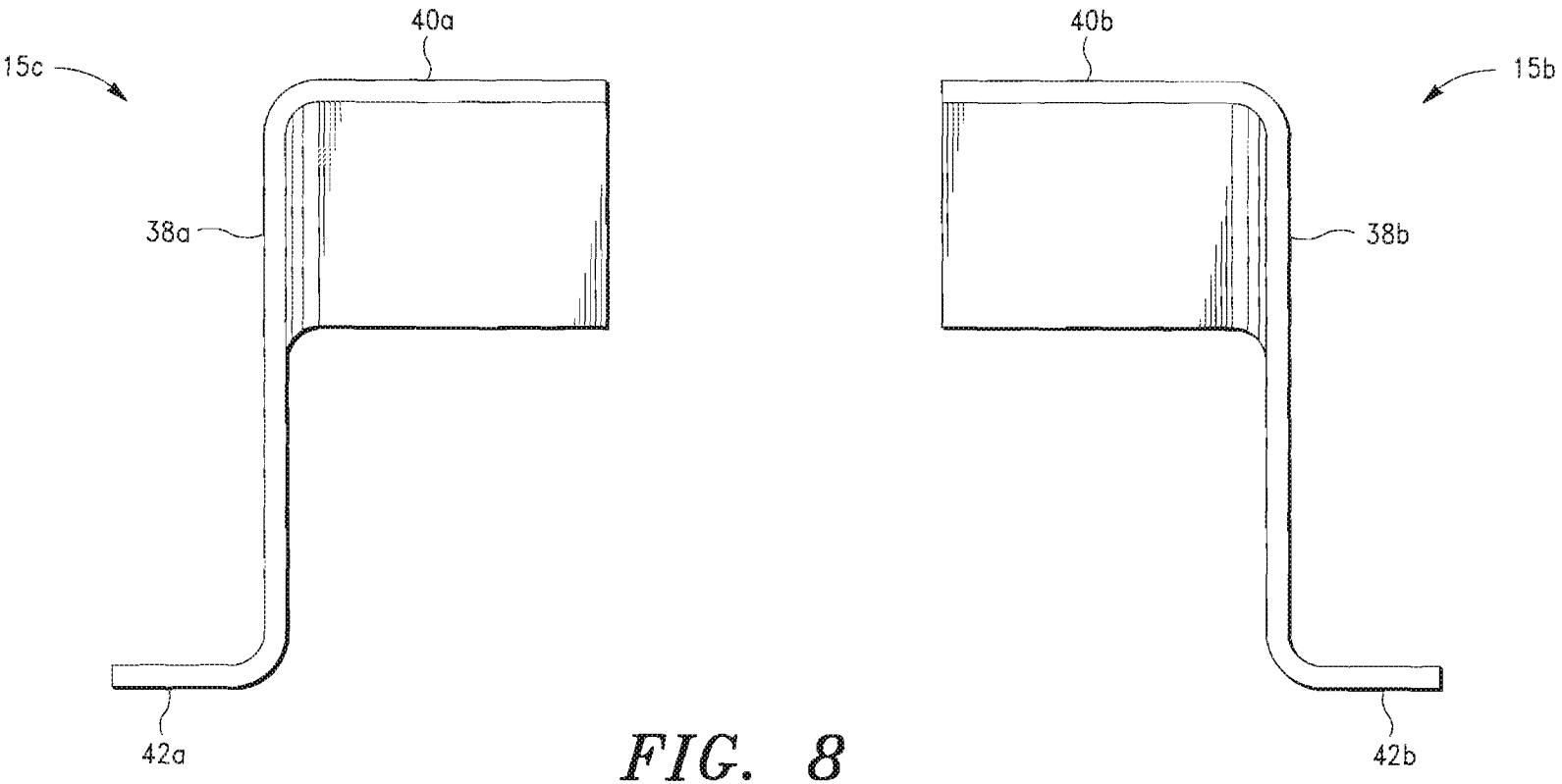
FIG. 8 is a rear, cross-sectional view of the side rails of one connector of the boat of FIG. 1.

For ease of reference, the pair of side rails 15*a* and 15*b* are depicted in FIG. 8 and described hereinafter, it being understood that the other side rail pairs 15*c* and 15*d*, 15*e* and 15*f* have the same construction. Looking to FIG. 8, each of side rails 15*a*, 15*b* has a central vertically extending beam 38*a*, 38*b*, a relatively planar top plate or flange 40*a*, 40*b* extending horizontally from the top-edge of the respective beam 38*a*, 38*b*, and a relatively planar bottom plate or flange 42*a*, 42*b* extending horizontally from the bottom-edge of the respective beam 38*a*, 38*b*. Each top plate 40*a*, 40*b* extends inwardly toward the other side rail in the pair, and each bottom plate 42*a*, 42*b* extends outwardly away from the other side rail in the pair.

Referring to FIGS. 3 and 6, connectors 14*a*, 14*b*, 14*c* are each preferably secured to platform 12 with a plurality of fasteners that extend through pre-formed openings in top plates 40 and a corresponding portion of the bottom of platform 12 into at least one of the stiffeners 36. The fasteners utilized may be nails, screws, bolts, and combinations thereof, with bolts being preferred. Connectors 14*a*, 14*b*, 14*c* are also preferably secured to platform 12 with an adhesive. Suitable adhesives include bonding composites such as Illinois Tool Works Company's ITW Plexus "Fiberglass Fusion." The adhesive is applied to the upper-surface of top plates 40 before joining them in abutting contact with the bottom surface of platform 12. It is also within the scope of the present invention that connectors 14*a*, 14*b*, 14*c* be secured to platform 12 either by using only fasteners or by using only an adhesive.

Connectors 14*a*, 14*b*, 14*c* may be formed of any material having sufficient strength and rigidity to secure the platform to the hulls or hull risers. Connectors 14*a*, 14*b*, 14*c* preferably are made of a relatively water impervious, non-corrosive, and lightweight material, more preferably metal, and most preferably aluminum.

As best shown in FIGS. 2, 3, 7 and 8, in one aspect of a preferred embodiment of the invention, connectors 14*a*, 14*b*, 14*c* are wedge-shaped, increasing in height from the front to the rear of the boat. In this way, the base of the boat increases in height toward the rear of the boat such that, when boat 10 is afloat and relatively stationary in calm water, the top surface of platform 12 extends generally parallel with the water line. The amount of increase in height from the front of the boat to the back will vary depending upon the overall length of the boat and the weight differential between the front and back of the boat. In a boat having a length ranging from 10 to 30 and a weight differential (when the motor is installed) of about 25% to 75% front weight relative to rear weight, the increase in height from front to rear of each of connectors 14*a*, 14*b*, 14*c* will range from 0 to 12 inches and/or will define a slope of about 1.5° to 3.5°. It should be understood that while wedge shaped connectors 14*a*, 14*b*, 14*c* are depicted as part of a preferred embodiment, it is also anticipated that connectors of uniform height from the rear to the front of boat 10 (and therefore not wedge-shaped) are within the scope of the present invention.

It should also be understood that the "base" of the multi-hull platform boat defined as that portion of the boat extending from the top of the platform to the bottom of the hulls can be wedge-shaped—increasing in height from the front to the rear—in other ways and regardless of whether the boat is constructed using a platform and longitudinal connectors as described heretofore or whether it is constructed in accordance with other designs. For example, boats constructed using traditional transversely extending crossbeams secured under the platform can be constructed with a wedge-shaped base by using cross-beams of increasing height from the front to the rear of the boat. In addition, a boat having a wedge-shaped base can also be constructed by using a wedge-shaped platform that increases in height from the front to the rear of the boat. Alternatively, a platform of uniform height can be installed on rear end risers that raise the platform near the rear of the boat. Furthermore, hulls that increase in height from the front to the rear of the boat can be utilized to create a wedge-shaped base. In all instances, the amount of increase in height will vary depending upon the length of the boat and weight differential from front to back. In a boat having a length ranging from 18 to 30 and a weight differential (when the motor is installed) of about 25% to 75% front weight to rear weight, the increase in height from the front to the rear of the boat will range from 0 to 12 inches and/or will define a slope of about 1.5° to 3.5°.

Figure 9:
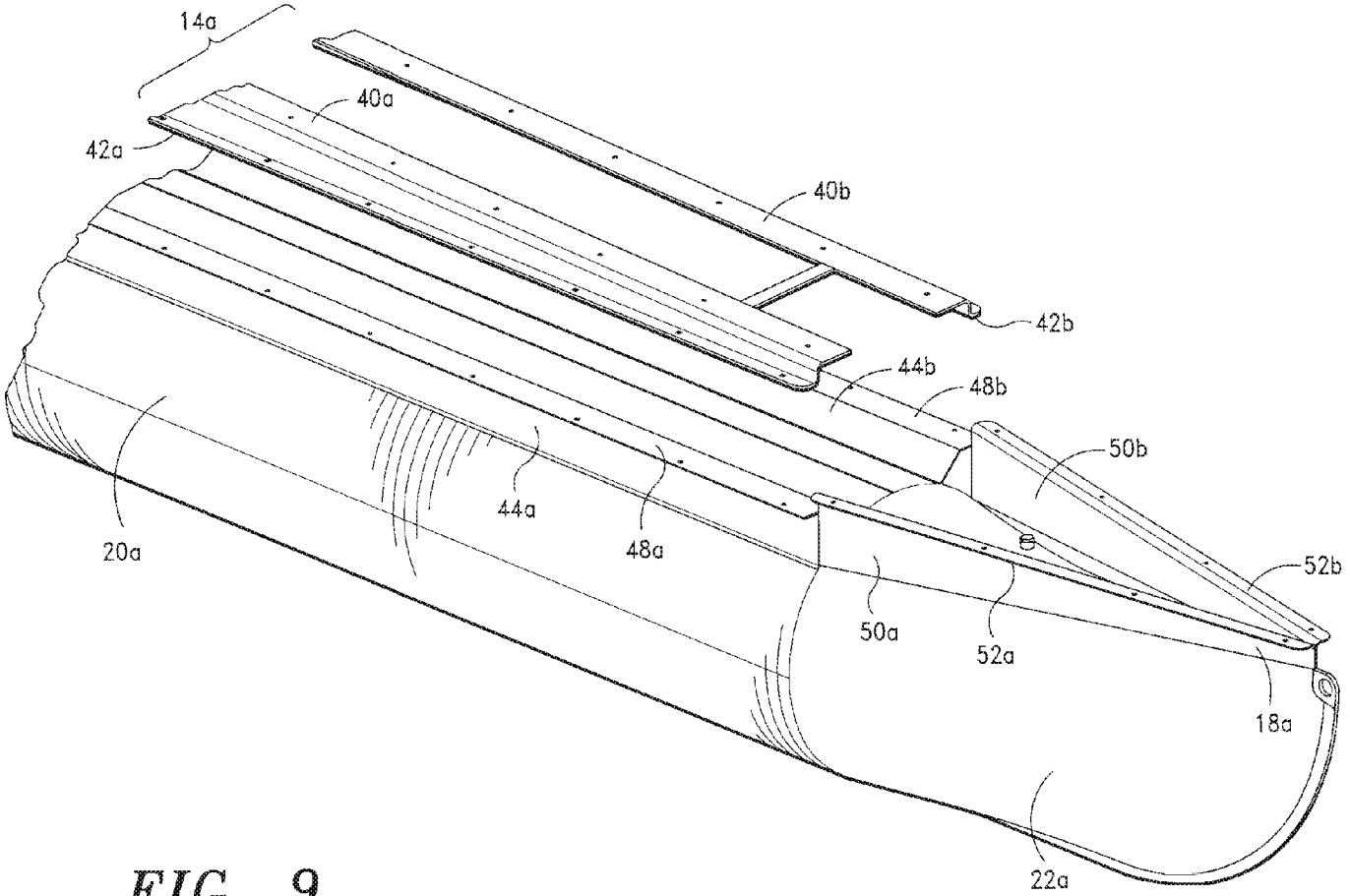
FIG. 9 is a partially exploded view of a portion of a hull and front nose cone with an associated hull riser, nose cone riser and connector attached.
Figure 10:
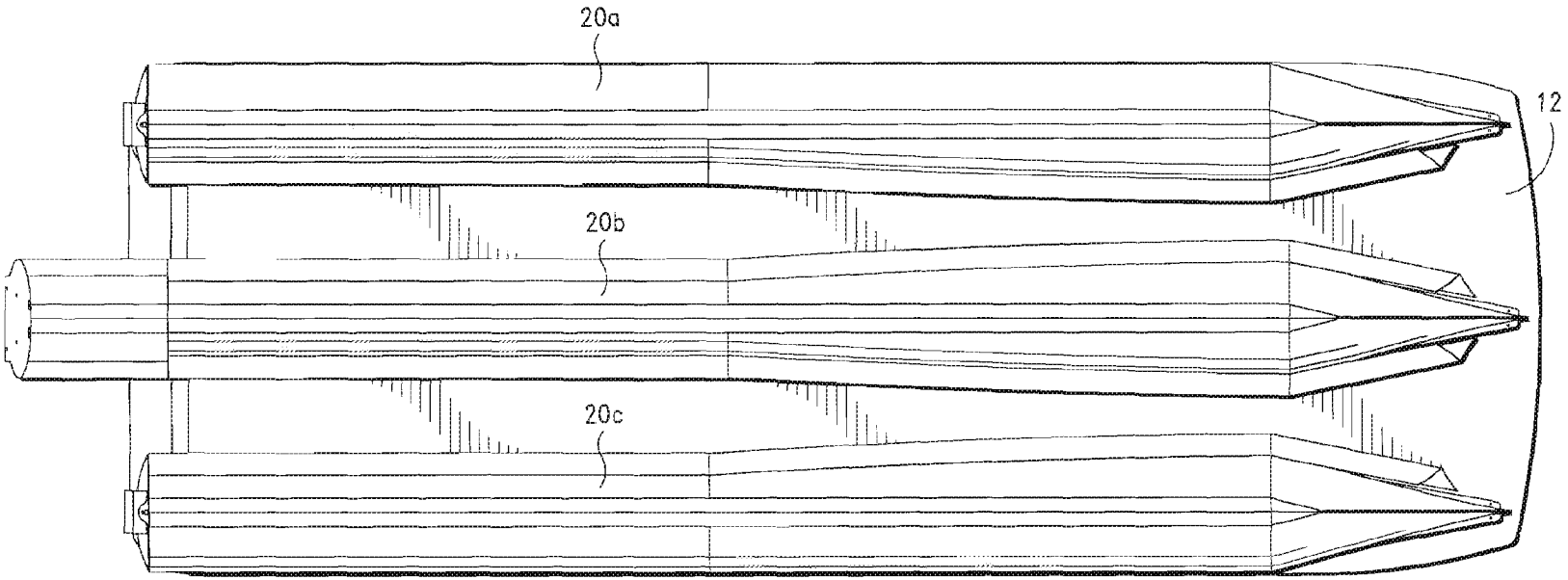
FIG. 10 is a bottom-plan view of the boat of FIG. 1.

Referring to FIGS. 3 and 9, connectors 14*a*, 14*b*, 14*c* are each secured to and align with respective hull risers 16*a*, 16*b*, 16*c*. The construction of connector 14*a* and hull riser 16*a* is shown in greater detail in FIG. 9 which is the same for connectors 14*b*, 14*c* and hull risers 16*b*, 16*c*. Hull riser 16*a* has a pair of elongated bases 44*a* and 44*b*, each extending longitudinally along one side of the top of hull 20*a*. Each base 44*a*, 44*b* includes a relatively planar flange 48*a*, 48*b* respectively extending generally horizontally outward from the top of base 44*a*, 44*b* in a direction away from the other base 44 in the pair. Bottom plates 42*a*, 42*b* of connector 14*a* align with respective elongated flanges 48*a*, 48*b* of hull riser 16*a* such that the bottom surface of each bottom plate 42*a*, 42*b* is in abutting contact with the top surface of each corresponding flange 48*a*, 48*b*. Bottom plates 42 and corresponding flanges 48 are secured in abutting contact together with fasteners that extend through corresponding pre-formed openings in the bottom plates 42 and elongated flanges 48. The fasteners utilized may be nails, screws, bolts, or other fasteners known in the art, as well as combinations thereof, with bolts being preferred. Looking to FIG. 3, bridges 46*a* and 46*c* extend transversely between the rear ends of bases 44 of respective outer hull risers 16*a* and 16*c*. Bridges 46*b*, 47*b* extend transversely between mid-sections of bases 44 of the middle hull riser to define the opening to storage compartment 25.

The construction of v-shaped nose cone riser 18*a* and nose cone 22*a* are also depicted in detail in FIG. 9, it being understood that the other v-shaped cone risers 18*b*, 18*c*, and nose cones 22*b*, 22*c* have the same construction. V-shaped nose cone riser 18*a* has a pair of bases 50*a* and 50*b* with front ends positioned adjacent one another at the front of respective nose cone 22*a* to form an apex and rear ends positioned adjacent front ends of corresponding hull riser bases 44*a*, 44*b*. It is noted that the nose cone riser bases 50*a*, 50*b* are taller than hull riser bases 44*a*, 44*b* a distance equal to the height of the front end of corresponding connector 14*a*. Each nose cone riser base 50*a*, 50*b* has a generally horizontal flange 52*a*, 52*b* extending outwardly from the top edge of each respective base 50 in a direction away from the other base 50 in the pair. The top surface of each flange 52*a*, 52*b* is aligned in the same plane with the top surface of corresponding connector plates 40*a*, 40*b*, and is secured in abutting engagement with the bottom surface of platform 12 via fasteners through pre-formed openings in the flanges. Nails, screws, bolts, or other fasteners known in the art, as well as combinations thereof may be used, with bolts being preferred. An adhesive may be utilized in addition to fasteners and may be the same bonding composite utilized to secure connectors 14 to platform 12. It is also within the scope of the present invention that nose cone risers 18 be secured to platform 12 using only an adhesive or only fasteners.

Referring to FIGS. 1-3 and 9, hull risers 16*a*, 16*b*, 16*c* are supported on and secured to the top of hulls 20*a*, 20*b*, 20*c* respectively. Nose cone risers 18*a*, 18*b*, 18*c* are supported on and secured to the top of nose cones 22*a*, 22*b*, 22*c* respectively. Hull risers 16 and nose cones 22 may be formed integrally with hulls 20 or may be secured to them using any means known in the art. In a preferred embodiment where hulls 20*a*, 20*b*, 20*c*, hull risers 16*a*, 16*b*, 16*c*, nose cones 22*a*, 22*b*, 22*c*, and nose cone risers 18*a*, 18*b*, 18*c* are all constructed of aluminum, the parts are secured together via welding.

Figure 11:
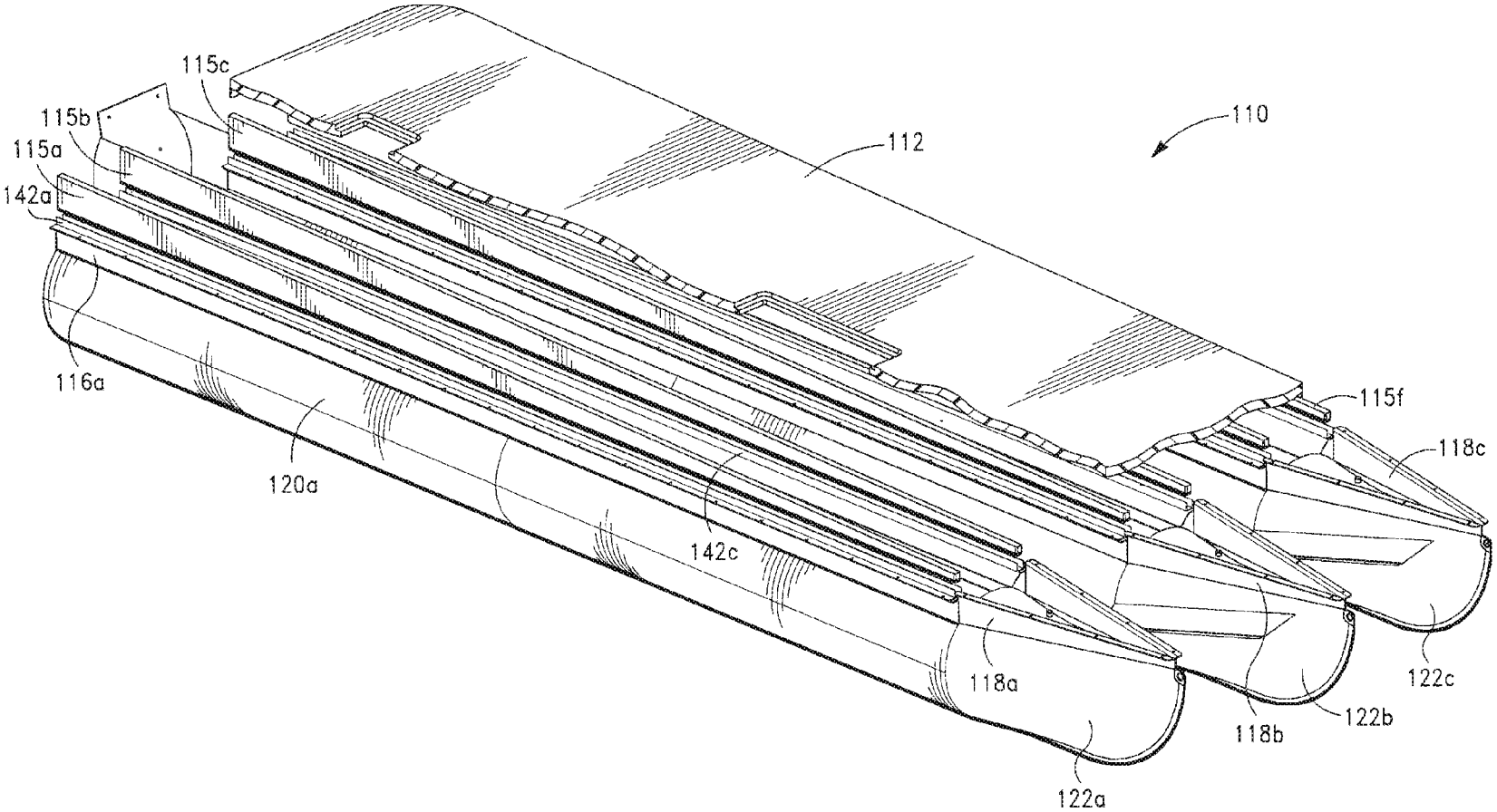
FIG. 11 is view of a multi-hull platform boat in accordance with a second exemplary embodiment of the present invention with a portion of the platform cut away.
Figure 12:
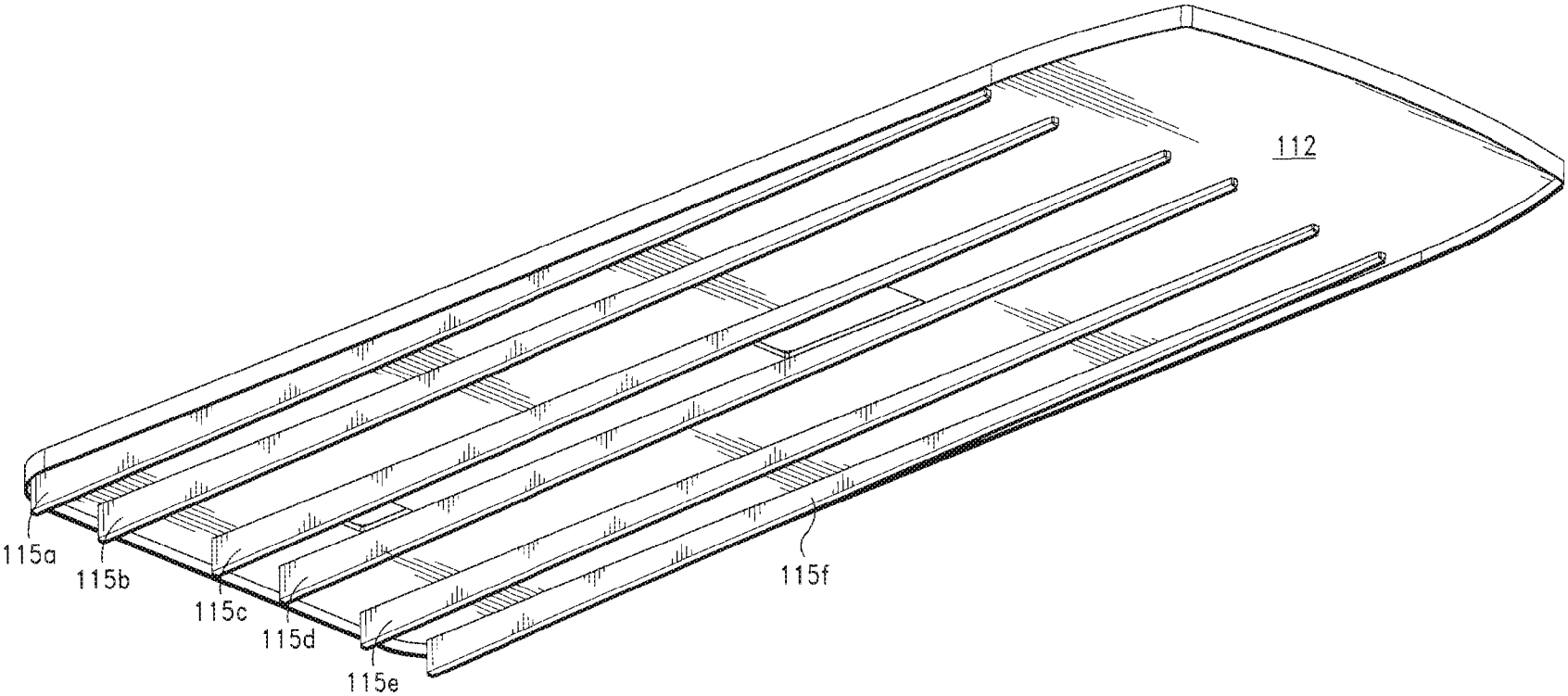
FIG. 12 is a bottom, perspective view of the platform and beams of the boat of FIG. 11.
Figure 13:
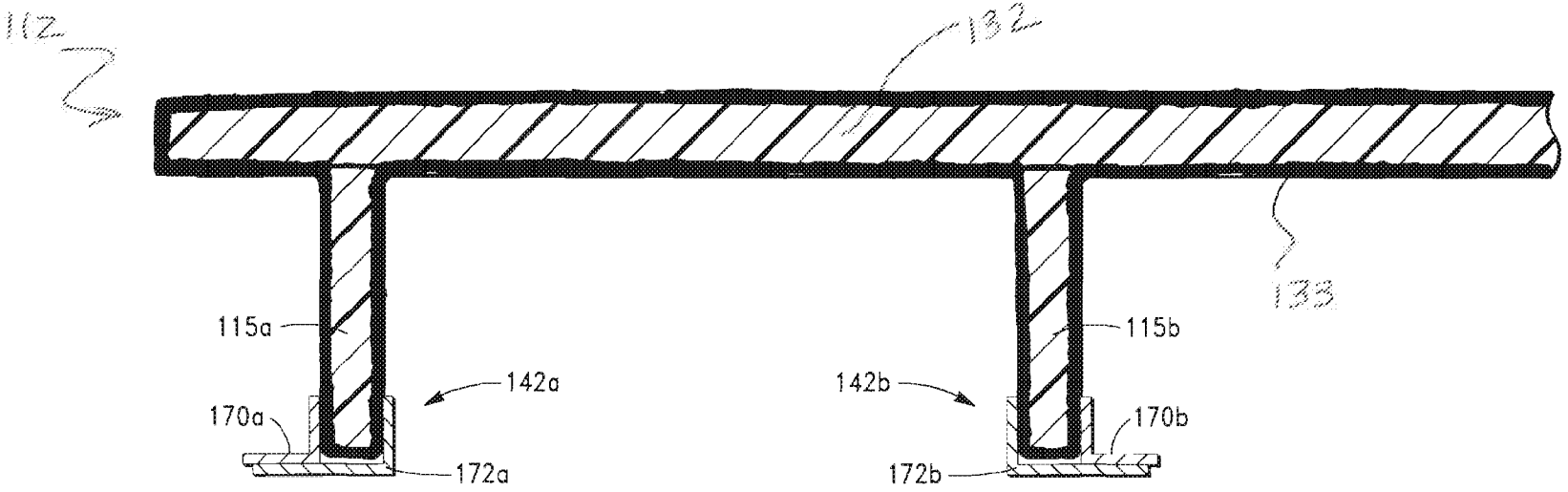
FIG. 13 is a front, cross-sectional enlarged view of a portion of the platform and a pair of beams and mounting brackets of the boat of FIG. 11.

Looking to FIGS. 11, 12, and 13, a multi-hull boat in accordance with a second exemplary embodiment of the present invention is generally designated by the numeral 110. Boat 110 includes a generally rectangular platform 112 defining the upper deck of the boat. Longitudinally extending pairs of beams 115*a* and 115*b*, 115*c* and 115*d*, 115*e* and 115*f* integrally formed with the bottom of platform 112 are mounted within corresponding pairs of mounting brackets 142*a* and 142*b*, 142*c* and 142*d*, 142*e* and 142*f*, which are in turn attached to corresponding hull risers 116*a*, 116*b*, 116*c* that extend upwardly from hulls 120*a*, 120*b*, 120*c*. Nose cone risers 118*a*, 118*b*, 118*c* extend upwardly from respective nose cones 122*a*, 122*b*, 122*c* and are secured along the underside of the front of platform 112. The platform 112, hull risers 116, hulls 120, nose cone risers 118 and nose cones 122 are generally configured, constructed and secured to one another as described in relation to boat 10 of the first exemplary embodiment. The key differences between boat 110 and boat 10 are the components connecting the platform to the hull risers. In the first exemplary embodiment, connectors 14 have pairs of side rails 15 secured to platform 12 and hull risers 16 using adhesive and/or fasteners. In this second exemplary embodiment, longitudinal beams 115 extend from the bottom of platform 112 and are mounted within mounting brackets 142 that are in turn secured to hull risers 116.

Looking to FIG. 11, beams 115 are identically positioned relative to platform 112, hull risers 116, nose cone risers 118, hulls 120, and nose cone risers 122 as connector side rails 15 are positioned relative to platform 12, hull risers 16, nose cone risers 18, hulls 20, and nose cone risers 22 in the first exemplary embodiment. Furthermore, in the preferred embodiment shown, beams 115—like connectors 14—are wedge-shaped, increasing in height from the front to the rear of the boat. The variance in height from the front to the rear of the boat is the same as described in regards to connectors 14. Alternatively, it is anticipated that mounting brackets 142 can be wedge-shaped, increasing in height from the front to the rear of the boat. It is likewise anticipated that beams 115 and mounting brackets 142 can be of uniform height from the front to the rear of boat 110 such that the base of the boat is not wedge-shaped.

Beams 115 may be formed of any material having sufficient strength and rigidity to secure platform 112 to the hull risers 116. Preferably, beams 115 have an inner core made of high density foam, plywood, plastic, metal or combinations thereof that is covered by or encased within an outer shell. This outer casing or shell is preferably formed of one or more moldable materials such as composite materials, high-density thermoplastics, high-density thermosets, fiber reinforced materials, fiberglass reinforced plastics, fiberglass, and combinations thereof as described in relation to the first exemplary embodiment. The outer shell of the beams may also be coated with a water impervious finish as heretofore described. While beams 115 depicted have a rectangular cross section, it is anticipated that other cross-sectional designs may be used, including but not limited to square, rectangular, trapezoidal, triangular or round.

For ease of reference, a pair of beams 115*a* and 115*b* and corresponding mounting brackets 142*a*, 142*b* are depicted in detail in FIG. 13, it being understood that the other beam pairs 115*c* and 115*d*, 115*e* and 115*f* and corresponding mounting brackets 142*a*, 142*d* and 142*f* have the same construction. Beams 115*a*, 115*b* are preferably integrally formed with the bottom of platform 112 such that the outer covering or shell of beams 115 is continuous with all or a portion of the lower support surface 133 of platform 112. A platform having beams integrally formed therewith may be made by positioning the inner core of each beam along the bottom surface of the platform inner core 132 and then the moldable material can be molded or laminated and cured around both the inner core of the platform and the inner cores of the beams. Alternatively the platform can first be fully formed as described in relation to the first exemplary embodiment and then the inner cores of the beams 115 can be secured to the bottom of the platform by molding or laminating additional layers of moldable material over and around the inner cores of the beams and onto surrounding portions of the bottom of the platform so as to securely fix the beams in position relative to the platform. Of course, it should be understood that the beams may be secured to the bottom of the platform using other fasteners and materials known in the art.

An integrally formed platform 112 may be constructed similarly to platform 12 of boat 10 in an open topped mold as discussed with regard to the first exemplary embodiment, wherein the lower shell surface of platform 112 faces up within the open top mold or form. The upper ends of the inner cores of beams 115 are placed in abutting contact with the bottom surface of the inner core 132 or within a layer of the lower support 133 of the platform. An adhesive, such as a bonding composite, may be applied between the upper ends of the inner cores of the beams and the lower surface of the platform to fix the inner cores of the beams in position. Suitable adhesives include bonding composites such as Illinois Tool Works Company's ITW Plexus "Fiberglass Fusion." The exposed surfaces of the inner cores of the beams are then wrapped or laminated with fiberglass layers or sheets that also extend over the remainder of the bottom of the inner core of the platform to form the lower support 133 of the platform. In this manner, the fiberglass layers form a continuous outer shell extending along the bottom of platform 112 and surrounding beams 115 extending therefrom. Finally, a water impervious finish such as a pigmented polyester resin coating (gel coat) or a two-part polyurethane finish (identical to that used to form outer coat 28) may be applied as described in the first exemplary embodiment to both beams 115 and platform 112. The finish and fiberglass resin are permitted to fully cure before removing the finished platform from the mold.

Referring to FIGS. 11 and 13, each pair of beams 115*a* and 115*b*, 115*c* and 115*d*, 115*e* and 115*f* is mounted within respective pairs of mounting brackets 142*a* and 142*b*, 142*c* and 142*d*, 142*e* and 142*f*. Looking to FIG. 13, mounting brackets 142*a*, 142*b* are each formed of respective pairs of upper and lower L-shaped straps 170*a* and 172*a*, 170*b* and 172*b*, each having a horizontally extending base plate and a vertical flange extending upwardly from one end of the base plate. The upper strap base plates are shorter than the lower strap base plates and are secured resting on top of a portion of the respective lower strap base plates, such that the vertical flanges extending upwardly from respective upper and lower straps are positioned at a distance from one another to define a U-shaped channel. This U-shaped channel corresponds in width to the width of the lower end of corresponding beam 115*a*, such that beam 115*a* can be received within the channel and supported therein. Straps 170, 172 may be made of a relatively water impervious, non-corrosive, and lightweight material, preferably metal, and most preferably aluminum. The upper and lower straps may be secured together using any suitable fasteners or materials and are most preferably welded together.

Beams 115 may be secured within the U-shaped channel using any suitable fasteners or materials, including nails, screws, or bolts, with bolts being most preferred. In one embodiment, openings are formed through the strap flanges and lower end of beams 115 along the length of the beams. Bolts are inserted through the openings to extend from an outer side of one flange through the beam to the outer side of the other flange in the pair and secured in position via nuts.

Each pair of mounting brackets 142*a*, 142*b* is configured such that the free ends of the base plates 170, 172, meaning the ends that do not include the upward extending flanges and corresponding U-shaped channel, extend in a direction away from the other mounting bracket in the pair. In this manner, the free ends of the base plates of each pair of mounting brackets extend along the outer edges of the mounting brackets in the pair above corresponding elongated flanges 148 of the hull risers 116. Mounting brackets 142 are secured in abutting contact with elongated flanges 148 of the hull risers via fasteners that extend through corresponding pre-formed openings in the base plates 170, 172 and elongated flanges 148. The fasteners utilized may be nails, screws, bolts or other fasteners known in the art, as well as combinations thereof, with bolts being preferred.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A boat comprising:

a plurality of longitudinally extending hulls;

a platform comprising a planar lower support made from a moldable material; and a plurality of longitudinally extending connectors, wherein each connector extends longitudinally between said platform and a respective one of said hulls and is secured directly or indirectly to a bottom of said platform and said respective one of said hulls.

2. The boat of claim 1, wherein an open unobstructed area extends from a bottom of said platform between those of said connectors and said hulls that are immediately adjacent one another.

3. The boat of claim 2, wherein the bottom of said platform positioned above said open unobstructed area is solid and planar.

4. The boat of claim 1, wherein said moldable material is selected from the group consisting of a composite material, a high density thermoplastic, a high density thermoset, fiberglass reinforced resins, fiberglass reinforced plastics, fiberglass and combinations thereof.

5. The boat of claim 1, wherein said moldable material is a fiber reinforced material.

6. The boat of claim 5, wherein said fiber reinforced material is fiberglass.

7. The boat of claim 1, wherein said platform additionally comprises a planar upper support made from said moldable material.

8. The boat of claim 7, wherein said platform additionally comprises an inner core positioned between said upper support and said lower support, wherein said inner core comprises one or more transversely extending stiffeners.

9. The boat of claim 8, wherein said stiffeners are hollow beams of aluminum.

10. The boat of claim 8, wherein said inner core additionally comprises a filler.

11. The boat of claim 1, wherein said platform additionally comprises an outer coating.

12. The boat of claim 11, wherein said outer coating is selected from the group consisting of a two-part linear polyurethane finish, a pigmented polyester resin coating and combinations thereof.

13. The boat of claim 1, wherein said connectors are wedge-shaped, increasing in height from a front portion to a rear portion of said boat.

14. The boat of claim 8, wherein said connectors are secured along a portion of the bottom of said platform with fasteners wherein each fastener extends through a portion of said lower support and at least one of said stiffeners.

15. The boat of claim 1, wherein a portion of said connectors are secured in abutting engagement with a portion of the bottom of said platform using an adhesive.

16. The boat of claim 1, wherein a portion of said connectors are integrally formed with the lower support of the platform.

17. A boat comprising:

a plurality of longitudinally extending hulls;

a platform comprising an inner core and a shell encasing said inner core; and one or more longitudinally extending connectors, wherein each connector is secured between a bottom of said platform and a top of one of said hulls.

18. The boat of claim 17, wherein said inner core comprises a filler material.

19. The boat of claim 18, wherein said inner core comprises at least one transversely extending stiffener.

20. The boat of claim 17, wherein said shell is formed of a moldable material.

21. The boat of claim 20, wherein said moldable material is a fiber reinforced material.

22. The boat of claim 17, wherein said platform further comprises an outer coating.

23. The boat of claim 17, wherein said connectors are wedge-shaped, increasing in height from a front portion to a rear portion of said boat.

24. A boat comprising:

a platform having a planar upper support surface;

a plurality of longitudinally extending hulls, wherein said platform is secured above said hulls, and wherein a base of the boat defined as that portion of the boat extending from the upper support surface of said platform down to a lowest point of said hulls, increases in height from a front portion to a rear portion of the boat.

25. The boat of claim 24, wherein said boat additionally comprises one or more connectors extending between said platform and said hulls and wherein said connectors increase in height from a front portion to a rear portion of said boat.

26. The boat of claim 25, wherein each said connector is wedge-shaped and extends longitudinally above one of said hulls.

27. The boat of claim 25, wherein each said connector extends transversely above two or more hulls.

28. The boat of claim 24, wherein said boat additionally comprises a plurality of longitudinally extending hull risers, wherein each hull riser is secured along an upper portion of a corresponding hull and is configured such that it increases in height from a front portion to a rear portion of the boat.

29. The boat of claim 24, wherein said platform is wedge-shaped, increasing in height from a front to a rear of said boat.

30. The boat of claim 24, wherein said hulls increase in height from a front to a rear of said boat.

* * * * *